US005751266A

United States Patent [19]

Crossland et al.

[11] Patent Number: 5,751,266

[45] Date of Patent: May 12, 1998

[54] CO-ORDINATE ADDRESSING OF LIQUID CRYSTAL CELLS

[75] Inventors: William Alden Crossland, Harlow Essex; Martin John Birch, Middlesex, both of United Kingdom

[73] Assignee: Northern Telecom Limited, Montreal, Canada

[21] Appl. No.: 984,427

[22] PCT Filed: Sep. 10, 1991

[86] PCT No.: PCT/GB91/01537

§ 371 Date: Feb. 24, 1993

§ 102(e) Date: Feb. 24, 1993

[87] PCT Pub. No.: WO92/04710

PCT Pub. Date: Mar. 19, 1992

[30] Foreign Application Priority Data

Sep. 11, 1990 [GB] United Kingdom ..... 9019868

[51] Int. Cl.[6] ..... G09G 3/36

[52] U.S. Cl. ..... 345/96; 345/209

[58] Field of Search ..... 340/765, 784, 340/805; 345/87, 94, 96, 209, 208

[56] References Cited

U.S. PATENT DOCUMENTS 4,062,626 12/1977 Kawakami et al. ..... 340/784

FOREIGN PATENT DOCUMENTS 0217893 8/1990 Japan ..... 340/784

OTHER PUBLICATIONS

Wahl, "Experimental driver and addressing techniques for ferroelectric liquid crystal devices", J. of Physics E/Scientific Instruments, vol. 21, No. 5, May, 1988, pp. 460–466.

*Primary Examiner*—Lun-Yi Lao

*Attorney, Agent, or Firm*—Lee, Mann, Smith, McWilliams, Sweeney & Ohlson

[57] ABSTRACT

A co-ordinate addressed bistable liquid crystal cell is switchable between its two stable states by oppositely directed electric potential differences applied across the liquid crystal layer thickness between a front-plane electrode and the members of a co-ordinate address array of electrode pads of an active back-plane. Refresh data is compared with currently displayed data so that only those pixels scheduled for switching are subjected to switching stimuli. The electrode pad of a pixel scheduled for switching is taken from the potential of the front-plane electrode to a different potential by connection to a voltage source. It is then electrically isolated from that voltage source for a further period before its potential is restored to that of the front-plane electrode. This enables rows of pixels to be addressed with a line address time considerably shorter than the time necessary to effect full switching.

13 Claims, 5 Drawing Sheets

CO-ORDINATE ADDRESSING OF LIQUID CRYSTAL CELLS

This invention relates to the co-ordinate addressing of liquid crystal cells. Co-ordinate addressing of such cells can be achieved by methods in which each pixel is defined as the area of overlap between one member of a set of row electrodes on one side of the liquid crystal layer and one member of another set of column electrodes on the other side. In an alternative co-ordinate addressing method the liquid crystal is backed by 'an active back-plane ' which has a co-ordinate array of electrode pads which are addressed on a co-ordinate basis within the active back-plane, and electrical stimuli are applied to the liquid crystal layer between individual members of this set of electrode pads on one side of the liquid crystal layer and a co-operating front-plane electrode on the other side of the liquid crystal layer. Generally the front-plane electrode is a single electrode, but in some instances it may be subdivided into a number of electrically distinct regions. The active back-plane may be constructed as an integrated single crystal semiconductor structure, for instance of silicon.

This invention relates in particular to the active back-plane addressing of liquid crystal cells whose response to an electrical stimulus is sensitive to the polarity of that stimulus.

In the electrical addressing of liquid crystal cells it is generally important to ensure that no pixels are subject to any significant long term cumulative charge imbalance that could give rise to electrolytic degradation effects within the cell. In the cases of cells whose response is not polarity sensitive, long-term charge balance can often be ensured by using charge-balanced a.c. stimuli throughout, but clearly there are problems in transferring this approach to the addressing of cells whose response is polarisation sensitive because in these circumstances the application of a charge-balanced a.c. stimulus to a pixel may make it make a temporary excursion from its initial state to some other state, but is then likely to restore it once again to its initial state.

In the ensuing description any particular pixel of a co-ordinate array of pixels is identified by its row and column co-ordinates. Whereas in conventional usage of the terms 'row' and 'column', rows and columns are respectively identified as horizontally-extending and vertically-extending lines; in this instance these terms are employed in a wider sense that does not imply any particular orientation of the row and column lines with respect to the horizontal, but merely that the sets of row and column lines intersect each other.

According to the present invention there is provided a method of addressing a liquid crystal cell having a co-ordinate array of pixels, wherein data for refreshing the cell is compared with the data existing prior to refresh to determine those pixels which require to have their states changed, and wherein those pixels are accessed by developing a positive, or negative, electric potential difference across those pixels, according into which state they are to be changed, for a predetermined period of time before re-establishing a zero potential difference, whereby no pixel is consecutively accessed twice by the same polarity of potential difference.

According to the present invention there is further provided a method of coordinate addressing a liquid crystal cell that includes a liquid crystal layer which, by the application of oppositely directed electric potential differences across the thickness of the layer, is enabled to be switched between two stable states, which cell is switchable between said two stable states using an active back-plane provided with a co-ordinate array of electrode pads on one side of the liquid crystal layer, which pads co-operate with a front-plane electrode on the other side of the liquid crystal layer to define an associated co-ordinate array of pixels within the liquid crystal layer, wherein data for refreshing the cell is compared, pixel address by pixel address, with pre-existing data currently displayed by the pixels to determine which pixels require to have their states changed, and wherein only those electrode pads whose associated pixels are pixels that require to have their states changed are accessed taking their potential from a potential equal to that of the front-plane electrode to a different potential for a predetermined period before restoring it to its former potential equal to that of the front-plane electrode, the different potential being either a predetermined amount above the potential of the front-plane electrode, or an equal amount below that potential.

By use of this method the potential maintained across any individual liquid crystal pixel is normally held at zero, and a non-zero potential is only developed when the pixel needs switching from one state to the other. Under these circumstances it is subjected to a unidirectional potential of known magnitude for a known limited duration. Assuming charge balance beforehand, this gives rise to a specific limited amount of charge imbalance but, because of the comparison process, it is never addressed twice consecutively in the same direction, and so it is possible to arrange matters so that the charge imbalance is not cumulative. The comparison process performed in the back-plane ensures that the next addressing of this pixel is in the opposite direction, and so the charge imbalance, if any, existing after the second addressing can be made equal to the charge imbalance, if, any, existing prior to its first addressing.

The invention also provides a back-plane co-ordinate addressed liquid crystal device, which device includes a liquid crystal cell containing a liquid crystal layer switchable, by the application of oppositely directed electric potential differences across the thickness of the layer, between two stable states, which cell has an active back-plane provided with a co-ordinate array of electrode pads on one side of the liquid crystal layer, which pads co-operate with a front-plane electrode on the other side of the liquid crystal layer to define an associated co-ordinate array of pixels within the liquid crystal layer, which device also includes a data processor which is adapted to compare data for refreshing the cell pixel address by pixel address with pre-existing data currently displayed by the pixels to determine which pixels require to have their states changed, and is adapted to refresh the cell by taking the potential, only of those electrode pads whose associated pixels are pixels that require to have their states changed, from a potential equal to that of the front-plane electrode to a different potential for a predetermined period before restoring it to its former potential equal to that of the front-plane electrode, the different potential being either a predetermined amount above the potential of the front-plane electrode, or an equal amount below that potential.

There follows a description of back-plane co-ordinate addressed liquid crystal devices and their method of operation embodying the invention in preferred forms. The description refers to the accompanying drawings in which.

Figure 1:
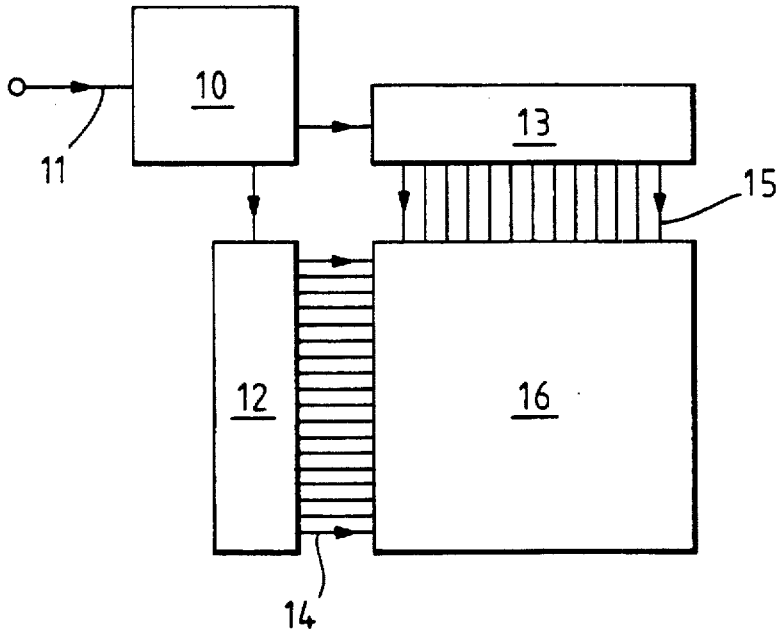
FIG. 1 is a block-diagram of a back-plane co-ordinate addressed liquid crystal device.
Figure 2:
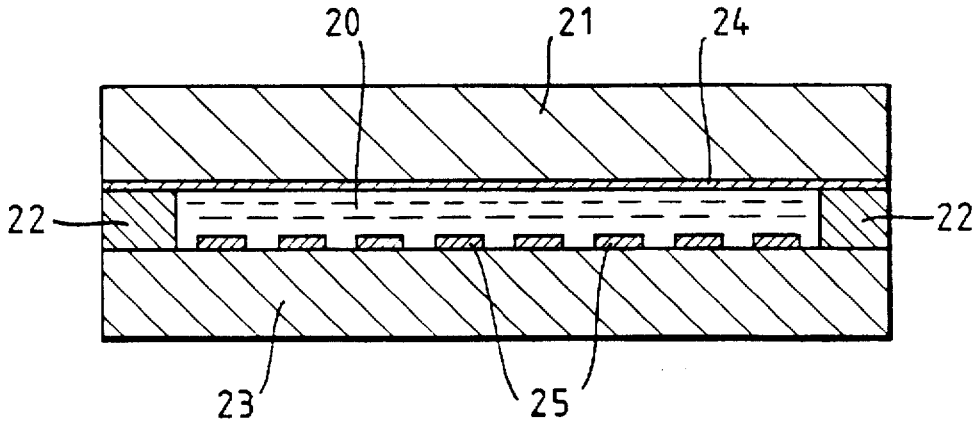
FIG. 2 depicts a schematic cross-section of the liquid crystal cell of the device of FIG. 1.

Referring to FIG. 1, a data processor 10 receives incoming data over an input line 11, and controls the operation of row and column addressing units 12 and 13 which provide inputs on lines 14 and 15 to the electrodes of a back-plane co-ordinate addressed liquid crystal cell 16 with pixels arranged in a co-ordinate array of n rows and m columns. In this cell 16 a hermetic enclosure for a liquid crystal layer 20 (FIG. 2) is formed by securing a transparent front sheet 21 with a perimeter seal 22 to a back sheet 23. Small transparent spheres (not shown) of uniform diameter may be trapped between the two sheets 21 and 23 to maintain a uniform separation, and hence uniform liquid crystal layer thickness. On its inward facing surface, the front sheet 11 carries a transparent electrode layer 24, the front-plane electrode layer, while a co-ordinate array of pixel pad electrodes 25 are similarly carried on the inward facing surface of the back sheet 23. These two inward facing surfaces are treated to promote a particular molecular alignment of the liquid crystal molecules in contact with these surfaces in the same direction. The back sheet 23 constitutes an active back-plane, by means of which the pixel pads 25 may be individually addressed on a row by row basis. Within its active structure, which may for instance be constructed in single crystal silicon, it contains the row and column addressing 12 and 13 units (FIG. 1), and may additionally contain the data processor 10. The area of overlap between the front-plane electrode layer 24 and an individual pixel pad 25 defines a pixel of the cell. The liquid crystal layer 20 is composed of a ferroelectric chiral smectic C material exhibiting long-term bistability when confined between the two major surfaces of its confining envelope. The thickness of the layer 20 is equal to an odd number of quarter wavelengths divided by the birefringence of the liquid crystal material, and it is viewed through a polariser (not shown). An individual pixel can be switched into one of these two bistable states by the application of a potential difference between its pixel pad 25 and the front-plane electrode 24. If the direction of that potential difference is reversed, the pixel is switched into the other bistable state.

The application of a potential difference in one direction across the thickness of the chiral smectic C phase layer 20 will promote alignment of the liquid crystal molecules in a direction inclined at an angle $\phi$ with respect to the parallel surface alignment directions, where $\phi$ is the tilt angle of the chiral smectic phase. A reversal of the potential difference will change the promoted molecular alignment to the angle—$\phi$ with respect to the parallel surface alignment directions. However in may instances some significant relaxation of alignment occurs upon removal of the switching potentials. Since some considerable period of time is liable to elapse between refreshings of any given pixel, such a pixel will normally be observed in its fully relaxed state. It is therefore preferred to employ a cell in which those relaxation effects are kept to a minimum. One such construction of cell in which these relaxation effects are minimised is described in our co-pending British patent application No. 9002105.6, to which attention is directed, in which surface alignment is provided by obliquely evaporated layers and the cell is subsequently 'conditioned' by the application of a relatively high potential difference across the thickness of its liquid crystal layer.

Figure 3:
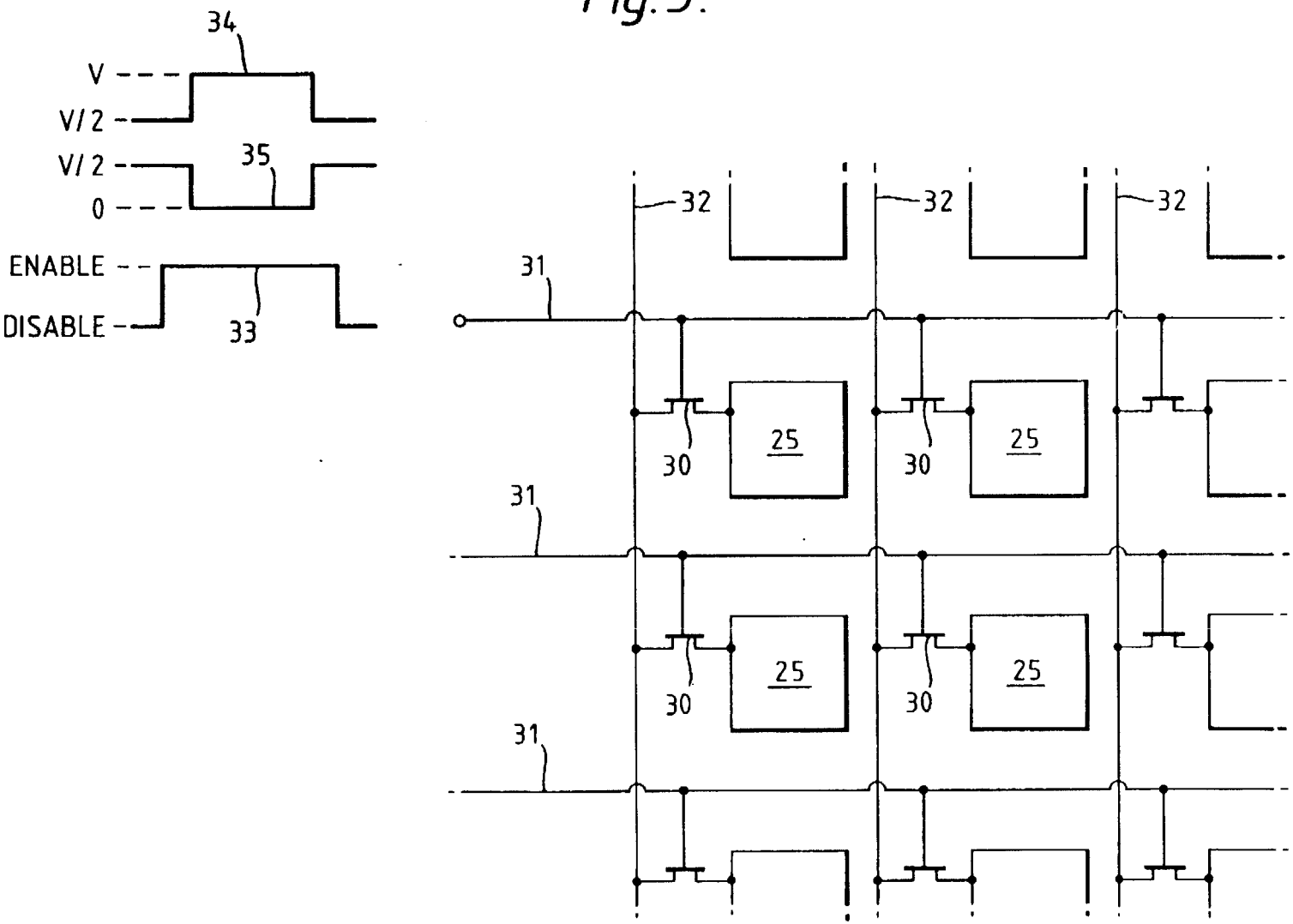
FIG. 3 is a diagram of a pixel pad addressing arrangement.

In the case of the pixel pad addressing arrangement of FIG. 3, a single gate 30 is associated with each pixel pad 25. All the gates of a row of pixel pads are enabled by the application of a suitable potential to a row electrode 31 associated with that row. Enablement of this row of gates serves to connect each pad with its associated column electrode 32. Normally the column electrodes are maintained at the potential of the front-plane electrode 24 (FIG. 2) so that no potential difference is developed across the pixel when its gate 30 is enabled. Under these circumstances the pixel will remain in its pre-existing state when that particular row of pixels is accessed by the enablement of the row of associated gates. If however a pixel requires to have its state changed, this is accomplished by applying a pulse to its associated column electrode during the enablement time slot.

Thus, while an enabling pulse 33 is applied on one of the column row electrodes 31, a pulse 34 applied on one of the electrode 32 lines will switch the addressed pixel into one bistable state, whereas an equivalent oppositely directed pulse 35 would switch it to the other bistable state. Pulses 34 and 35 terminate before the end of pulse 33 so that the potential developed across the pixel to switch it is removed from the pixel before the pixel pad is once again isolated by the disablement of its associated gate.

The pulses 34 and 35 have to be of long enough duration to cause the pixel to switch. The pulse 33 has to be even longer, because it must additionally give time for the potential to be removed from the pixel pad when a pulse 34 or 35 has terminated.

Normally the liquid crystal switching time is quite long compared with the time required to charge up or discharge a pixel pad. Thus a drawback of this approach is that the minimum line address time, the minimum duration of a pulse 33, is liable to be considerably longer than the time necessary to charge up a pixel pad to its required potential.

Figure 4:
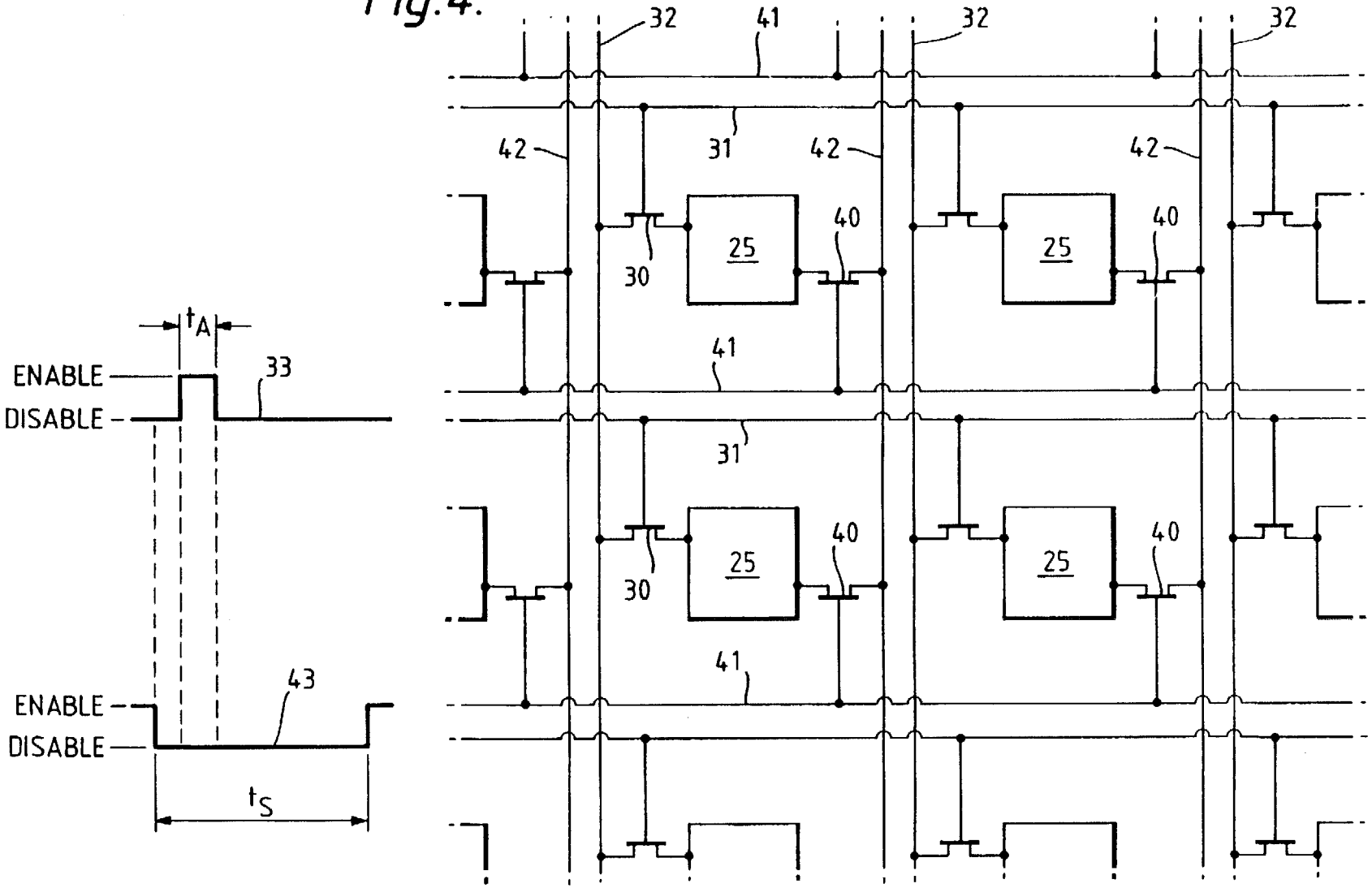
FIG. 4 is a diagram of an alternative pixel pad addressing arrangement employing an extra gate per pixel.

This problem can be overcome by adopting the addressing arrangement of FIG. 4, which involves the use of an extra gate 40 for each pixel pad, and the use of extra row and column electrodes 41 and 42. The column electrodes 42 are all maintained at the potential of the front-plane electrode 24 (FIG. 2) so that, whenever a gate 40 is enabled, no potential difference is developed across its associated pixel. The row electrodes 41 are normally maintained at a potential causing their associated gates to be sustained in their enabled states. When a row of pixels is to be addressed, a pulse 43 is applied to the relevant pixel pad row electrode 41 to disable all the gates 40 of that row just before the commencement of the pulse 33 applied to the corresponding row electrode 31 that enables all the gates 30 of the row. Meanwhile the column electrodes 32 have been connected on an individual basis by gates (not shown in FIG. 4) to any one of three voltage rails (not shown in FIG. 4). The second rail is maintained at the potential of the front-plane electrode, while the first and third rails are maintained at potentials respectively an equal amount above and below the front-plane electrode potential. Thus a gate set to connect the column electrode 32 to the first rail causes a potential to be applied to the relevant pixel pad tending to switch the pixel to one particular state. If set to connect the column electrode 32 to the third rail, the gate would cause a potential to be applied tending to switch the pixel to the other state; whereas, if set to connect the column electrode 32 to the second rail, no potential would be developed across the pixel and hence it would remain in its pre-existing state. Pulse 43 is of longer duration than pulse 33 and so terminates after the termination of pulse 33. When the pulse 33 terminates, the gates 30 of the addressed row resume their disabled states, and hence, neglecting leakage effects, the potentials now appearing on the individual pixel pads are sustained until the termination of pulse 43. At this stage, gates 40 of the addressed row are once again enabled, and the potentials, if any, developed across the individual pixels of the row are reduced to zero.

Figure 5:
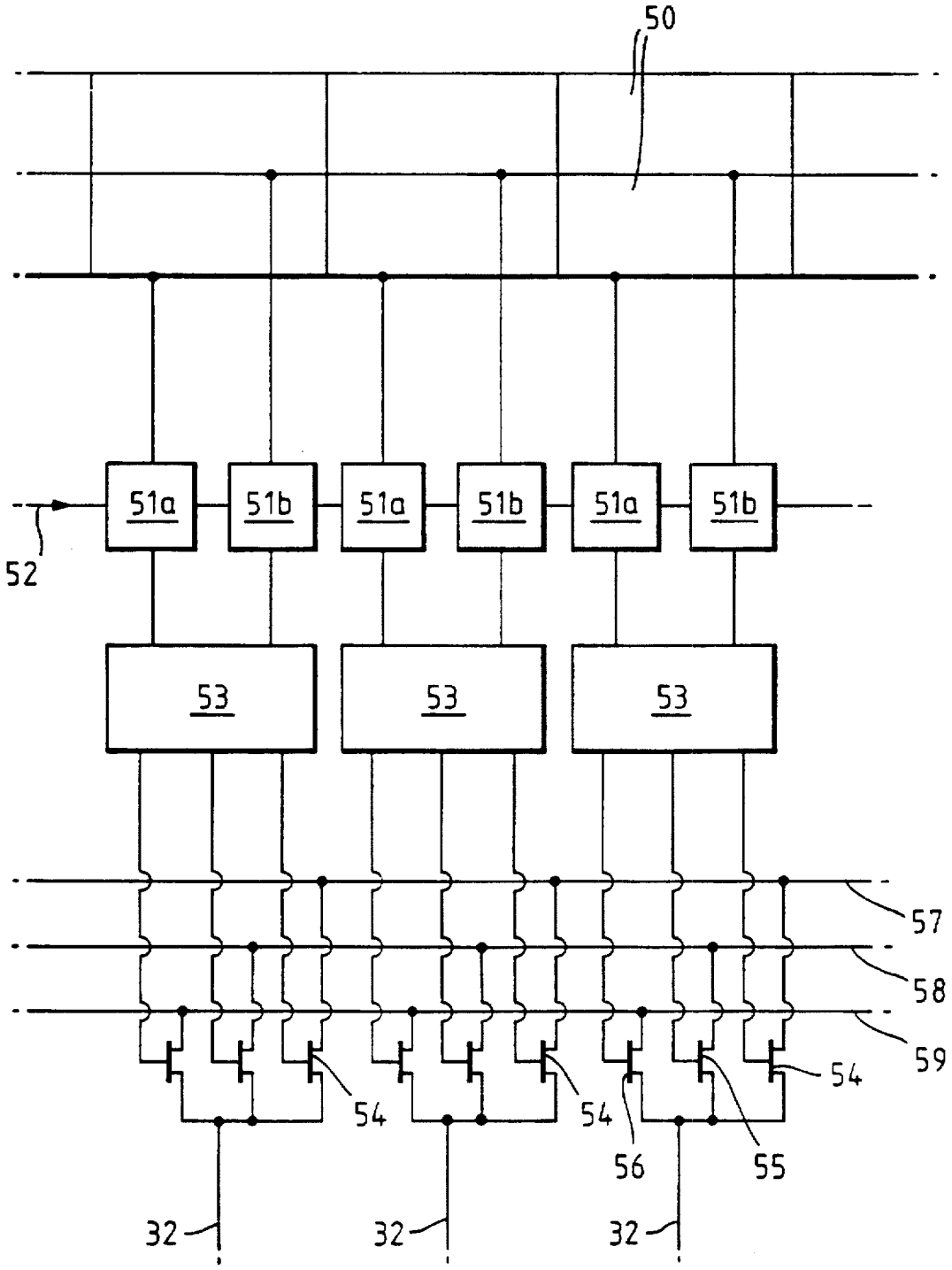
FIGS. 5 and 6 are respectively diagrams of parts of the column and row addressing units of the device of FIG. 1.

Incoming data with which the device is to be addressed is fed over line 11 to the data processor 10, which compares the incoming data pixel-by-pixel with a record of the data currently being displayed by the liquid crystal cell 16. A portion of the column address unit 13 (FIG. 1) is depicted in greater detail in FIG. 5. A row of pixels of the display is refreshed from data fed from the data processor 10 (FIG. 1) into a 2-bit m-stage shift register 50 (FIG. 5), where m is the number of pixels in each row. The two bits of the $p^{th}$ stage of the shift register characterise whether the $p^{th}$ pixel is scheduled for switching to the data '1' state from the data '0' state, for switching to the data '0' state from the data '1' state, or for retaining the pixel in its pre-existing state, whether that was data '0' or data '1'.

Associated with each stage of the shift register 50 is a pair of latches 51*a* and 51*b* respectively coupled with the first and second bits of that stage of the shift register 50. Under the control of a clock pulse applied to latch line 52, the data is entered from the shift register 50 into the latches 51 where it is employed by logic units 53 to enable the appropriate one of three gates 54, 55 and 56 so as to connect the pixel column electrode 32 either to rail 58 maintained at the potential of the front-plane electrode or to rail 57 or 59, respectively maintained at potentials equal amounts positive and negative with respect to the front-plane potential.

Figure 6:
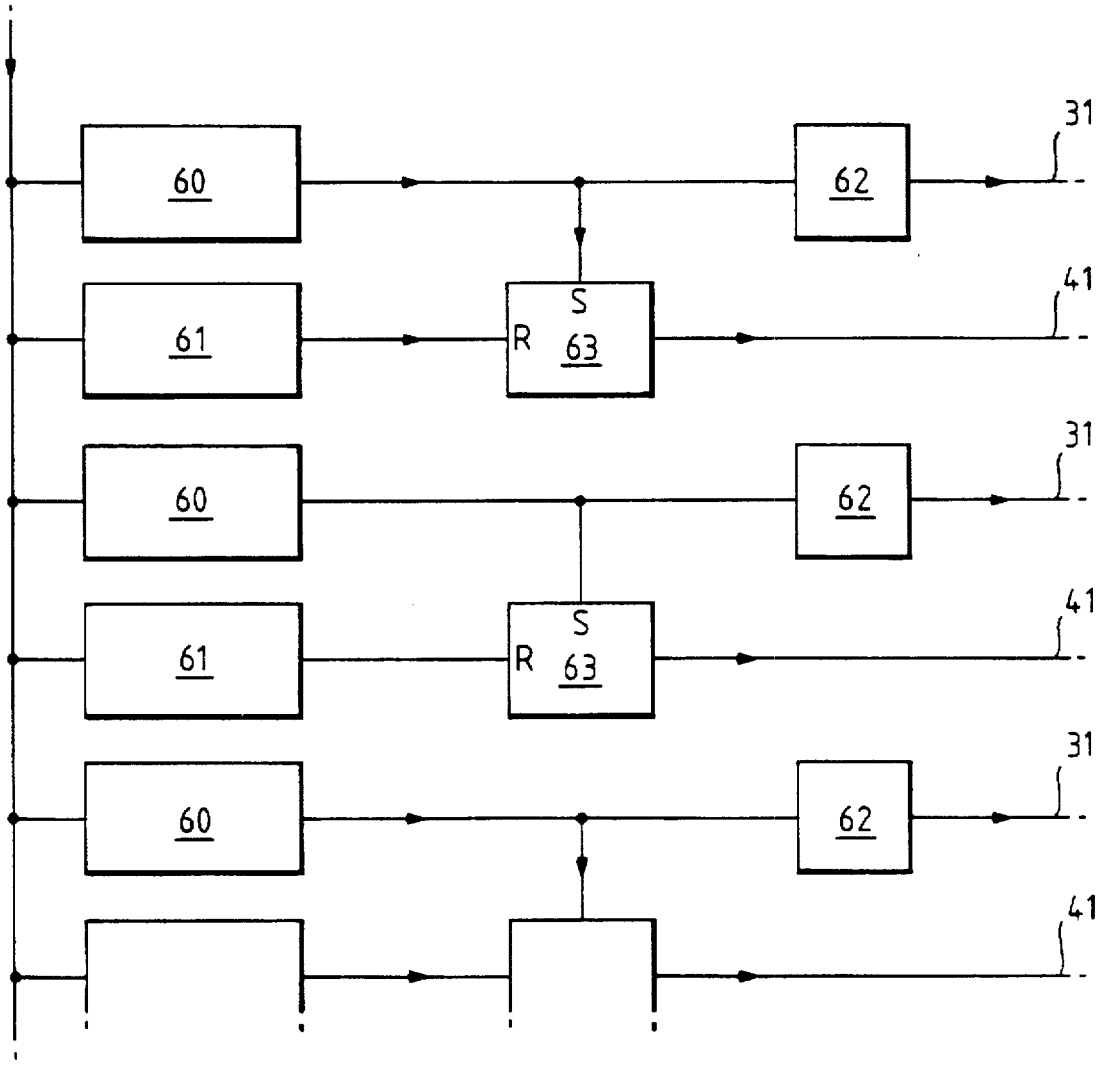

In this way the processor 10 sets up a refresh row of data for the pixels of the cell 16 in the shift register 50 of the column address unit 13, and the latches 51 employ the data, through the agency of the logic units 53 and the sets of gates 54, 55 and 56, to set up the requisite potentials on column electrodes 32 for entry of that row. Selection of the appropriate pixel row of the cell 16 into which the data is to be entered is under the control of the row addressing unit 12, a portion of which is shown in greater detail in FIG. 6.

The pixels of cell 16 are arranged in n rows, and so the row address unit has 2n decoder trees arranged in pairs so that there is a pair of decoder trees 60 and 61 associated with each row. The output of decoder tree 60 of the $r^{th}$ row of pixels is connected via a delay unit 62 to row electrode 31 of that row. Associated with each pair of decoder trees is an RS flip-flop 63 whose set and reset inputs are connected to the outputs of decoder trees 60 and 61 respectively. The output of the flip-flop 63 is connected to the row electrode 41 of that row. In the quiescent state of the two decoder trees of that pixel row in which the row is not being addressed, the output of decoder tree 60 is such as to hold the row electrode 31 of that row at a potential which maintains the gates 30 in their disabled states. Additionally, in this condition, the output of the flip-flop 63 is such as to hold the row electrode 41 of that row at a potential which maintains the gates 40 in their enabled states. Thus, in this condition, all the pixel pads 25 of the row are maintained via column electrodes 42 at the potential of the front-plane electrode 24.

The sequence of events involved in the refreshing of this row of pixels is that the data processor 10 directs a signal to the decoder trees to address decoder tree 60 of the $r^{th}$ row. This causes the decoder tree 60 to set the flip-flop 63, thereby causing the disablement of the gates 40 of that row and thus the electrical isolation of the pixel pads 25. The delay unit 62, which may for instance be constituted by a series connected pair of inverters, ensures that this isolation occurs before the signal from decoder tree 60 is able to propagate through the delay unit and cause the enablement of the gates 30 of the row. Enablement of these gates 30 causes the pixel pads 25 to be charged to the selected rail potential of the rails 57, 58 and 59 in accordance with the data at that time held in the latches 51. The signal applied to the decoder tree 60 from the data processor 10 is maintained for a sufficient time for these pixel pads to charge up to the row potentials before being removed and thus cause the associated gates 30 to be restored to their disabled states. At this stage the potentials developed across the pixels of the addressed row have not been maintained long enough to cause the pixels scheduled for switching yet to have become fully switched, but the data processor is now able to proceed with setting a fresh row of data of a different row into the column addressing unit 13, and to start the sequence in the row addressing unit 12 for the entry of the data into that different row into the cell 16. When sufficient time has elapsed for the pixels to have become fully switched, the data processor 10 directs another signal to the decoder trees to address decoder tree 61 of the $r^{th}$ row to cause it to reset the flip-flop 63. This causes the enablement of the gates of 40 of the $r^{th}$ row, and thus the discharge of the potentials held on the pixel pads of that row.

In this way the cell 16 can be refreshed with new rows of data using a row address time, $t_A$, which can be considerably shorter than the time, $t_S$, for which a potential difference has to be maintained across any given pixel to cause it to switch from one of its bistable states to the other. The durations $t_A$ and $t_S$ are regulated by the data processor 10, and hence can be arranged to be controlled by software so as to give the facility for easy adjustment. Alternatively, if the durations do not require changing, they can be determined by hardware, for instance by monostables. Under these circumstances there need be only one decoder tree per row, decoder tree 60. When a decoder tree 60 is addressed by the data processor 10 it sets first and second monostables (not shown). The first monostable is connected to reset the decoder 60 after a fixed duration $t_A$, while the second monostable is connected to reset the flip-flop 63 after a duration $t_S$. Typically the duration $t_S$ will be at the very least more than twice the duration $t_A$, and may be much more than ten times.

In the foregoing description it has been tacitly assumed that the front-plane electrode is at all times maintained at a constant potential. If the construction of the back-plane sheet 23 is such that it is able to drive the pixel pads 25 within the voltage range from 0 volts to V volts then, if the front-plane electrode is to be maintained at a fixed potential, this fixed potential is preferably V/2. This allows a maximum potential difference of +V/2 or −V/2 to be developed across any pixel. This value can be increased to a potential difference of +V or −V by arranging to alternate the potential of the front-plane electrode between O and V, but under these circumstances a pair of refreshings of a row of pixels is required in order to provide a complete refreshment because an individual refreshing is capable of switching pixels in one direction only. One refreshing of the pair of refreshings is with the front-plane electrode maintained at 0 volts, and the other is with the front-plane electrode maintained at V volts.

With the fixed front-plane potential arrangement, the three rails 57, 58 and 59 are respectively maintained at 0 volts, V/2 volts and V volts, but with an alternatively front-plane potential arrangement only rails 57 and 59, as before respectively maintained at 0 volts and V volts, are required.

When the front-plane electrode is maintained at 0 volts, a potential difference of +V can be developed across a pixel by raising the potential of its pixel pad 25 to V volts. Arbitrarily designating the transition that such a potential difference induces as the data '0' to data '1' transition, it follows that, while the front-plane electrode is maintained at 0 volts, it is possible to induce data '0' to data '1' transitions, but not possible to induce data '1' to data '0' transitions. The latter require the development of a potential difference of −V. Accordingly, while the front-plane electrode potential is maintained at 0 volts, those pixels of a row being refreshed that are scheduled for making the data '1' to data '0' transition are treated in the same way by the column address unit 13 as those pixels of the row scheduled for being retained in their pre-existing states, that is to say their column electrodes 32 are connected to the rail that is maintained at the currently maintained potential of front-plane electrode, namely rail 57. Then, while all gates 30 are disabled and all gates 40 are enabled, the potential of the front-plane electrode 24, is raised together with that of the column electrodes 42, from 0 volts to V volts preparatory for the second of the pair of refreshings of this row. With the front-plane electrode row at V volts, it is possible to develop a potential difference of −V across a pixel, but not a potential difference of +V. Accordingly those pixels that were scheduled for making the data '0' to data '1 ' transition in the first refreshing of this pair of refreshings, and indeed made that transition, are now treated in the same way as those pixels scheduled for making neither transition in this pair of refreshings, that is to say their column electrodes 44 are connected to the rail that is maintained at the currently maintained potential of the front-plane electrode, namely rail 59.

It thus becomes clear that the column electrodes of pixels not scheduled to make either transition in either of the pair of refreshings need to be connected to rail 57 during the first refreshing, and to rail 59 during the second refreshing. This means that either the logic units 53 must include inputs that characterise the front-plane electrode potential, or that the data in the shift register 50 has to be rewritten between the first and the second pair of addressings. If the latter approach is adopted, each stage of the shift register 50 is required to contain only one bit of information rather than two, namely an indication as to whether or not the associated pixel is scheduled for making the data state transition that is possible with this particular refreshing. The shift register can thus be a one-bit m-stage register rather than a two-bit one.

One particular application for these back-plane co-ordinate addressed liquid crystal devices is as the active element of a matrix vector multiplier, for instance for use as an optical cross-bar switch. In such a matrix vector multiplier a columnar array of n optical sources is optically arranged relative to the pixels of the co-ordinate array of the cell so that the $p^{th}$ element of the column of sources is optically coupled with all m pixels of the $p^{th}$ row of the co-ordinate array, while similarly a row array of m optical detectors is optically arranged relative to the pixels so that all n pixels of the $r^{th}$ column of the co-ordinate array are optically coupled with the $r^{th}$ element of the row of detectors. Conveniently a polarisation beam splitter is employed in the optical coupling of the sources and detectors with the co-ordinate array in order to provide the dual function of separating the input and output beams and of providing the necessary polariser for operation of the device.

We claim:

1. A method of addressing a liquid crystal cell having a co-ordinate array of pixels, wherein data for refreshing the cell is compared with the data existing prior to refresh to determine those pixels which require to have their states changed, and wherein those pixels are accessed by developing a positive, or negative, electric potential difference across those pixels, according into which state they are to be changed, for a predetermined period of time before re-establishing a zero potential difference, whereby no pixel is consecutively accessed twice by the same polarity of potential difference.

2. A method as claimed in claim 1, wherein, the modulus of the potential difference applied across a pixel to charge it from one state to another is matched by the modulus of the potential difference applied across that pixel to change it from the other state to that one, and wherein the duration of potential difference application for switching it from one state to the other is matched by the duration for switching it from the other state to that one.

3. A method of co-ordinate addressing a liquid crystal cell that includes crystal layer which, by the application of oppositely directed electric potential differences across the thickness of the layer, is enabled to be switched between two stable states, which cell is switchable between said two stable states using an active back-plane provided with a co-ordinate array of electrode pads on one side of the liquid crystal layer, which pads co-operate with a front-plane electrode on the other side of the liquid crystal layer to define an associated co-ordinate array of pixels within the liquid crystal layer, wherein data for refreshing the cell is compared, pixel address by pixel address, with preexisting data currently displayed by the pixels to determine which pixels require to have their states changed, and wherein only those electrode pads whose associated pixels are pixels that require to have their states changed are accessed taking their potential from a potential equal to that of the front-plane electrode to a different potential for a predetermined period before restoring to its former potential equal to that of the front-plane electrode, the different potential being either a predetermined amount above the potential of the front-plane electrode, or an equal amount below that potential.

4. A method as claimed in claim 3, wherein, in the addressing of a pixel to switch it from either one of the two states to the other, its associated electrode pad is charged to a potential different from that of the front-plane electrode by connection to a voltage source for a first duration, which connection is removed to leave the pad electrically isolated at said different potential for the second duration, after which the pad is discharged to the potential of the front-plane electrode.

5. A method as claimed in claim 4, wherein said second duration is at least as great as said first duration.

6. A method as claimed in claim 3, wherein the potential of the front-plane electrode is alternated between first and second levels, being maintained at the first level for the switching of pixels from a selected one of the two stable states to the non-selected state, and being maintained at the second level for the switching of pixels from the non-selected state to the selected state.

7. A method as claimed in claim 6, wherein, in the addressing of a pixel to switch it from either one of the two states to the other, its associated electrode pad is charged to a potential different from that of the front-plane electrode by connection to a voltage source for a first duration, which connection is removed to leave the pad electrically isolated at said different potential for the second duration, after which the pad is discharged to the potential of the front-plane electrode.

8. A back-plane co-ordinate addressed liquid crystal device, which device includes a liquid crystal cell containing a liquid crystal layer switchable, by the application of oppositely directed electric potential differences across the thickness of the layer, between two stable states, which cell has an active back-plane provided with a co-ordinate array of electrode pads on one side of the liquid crystal layer, which pads co-operate with a front-plane electrode on the other side of the liquid crystal layer to define an associated co-ordinate array of pixels within the liquid crystal layer, which device also includes a data processor which is adapted to compare data for refreshing the cell pixel address by pixel address with pre-existing data currently displayed by the pixels to determine which pixels require to have their states changed, and is adapted to refresh the cell by taking the potential, only of those electrode pads whose associated pixels are pixels that require to have their states changed, from a potential equal to that of the front-plane electrode to a different potential for a predetermined period before restoring it to its former potential equal to that of the front-plane electrode, the different potential being either a predetermined amount above the potential of the front-plane electrode, or an equal amount below that potential.

9. A back-plane co-ordinate addressed liquid crystal device as claimed in claim 8, wherein each electrode pad is connected by way of a first gated electrical path to a source of potential maintained at the potential of the front-plane electrode, and by way of a second stated electrical path to one of three sources of potential, one maintained at the potential of the front-plane electrode and the other two maintained at potentials equally above and below the front-plane electrode potential.

10. A back-plane coordinate addressed liquid crystal device as claimed in claim 8, wherein each electrode pad is connected by way of a first gated electrical path to a source of potential maintained at the potential of the front-plane electrode, and by way of a second gated electrode path to one of two sources of potential, one maintained at the potential of the front-plane potential and the other to a potential alternately maintained at potentials equally above and below the front-plane electrode potential.

11. A matrix vector multiplier incorporating a back-plane co-ordinate addressed liquid crystal device, which device includes a liquid crystal cell containing a liquid crystal layer switchable, by the application of oppositely directed electric potential differences across the thickness of the layer, between two stables states, which cell has an active back-plane provided with a co-ordinate array of electrode pads on one side of the liquid crystal layer, which pads co-operate with a front-plane electrode on the other side of the liquid crystal layer to define an associated co-ordinate array of pixels within the liquid crystal layer, which device also includes a data processor which is adapted to compare data for refreshing the cell pixel address by pixel address with pre-existing data currently displayed by the pixels to determine which pixels require to have their states changed, and is adapted to refresh the cell by taking the potential, only of those electrode pads whose associated pixels are pixels that require to have their states changed, from a potential equal to that of the front-plane electrode to a different potential for a predetermined period before restoring it to its former potential equal to that of the front-plane electrode, the different potential being either a predetermined amount above the potential of the front-plane electrode, or an equal amount below that potential.

12. A matrix vector multiplier as claimed in claim 11, wherein each electrode pad is connected by way of a first gated electrical path to a source of potential maintained at the potential of the front-plane electrode, and by way of a second stated electrical path to one of three sources of potential, one maintained at the potential of the front-plane electrode and the other two maintained at potentials equally above and below the front-plane electrode potential.

13. A matrix vector multiplier as claimed in claim 11, wherein each electrode pad is connected by way of a first gated electrical path to a source of potential maintained at the potential of the front-plane electrode, and by way of a second gated electrode path to one of two sources of potential, one maintained at the potential of the front-plane potential and the other to a potential alternately maintained at potentials equally above and below the front-plane electrode potential.

* * * * *